US005584568A

United States Patent [19]

Corbasson et al.

[11] Patent Number: 5,584,568

[45] Date of Patent: Dec. 17, 1996

[54] LIGHTING METHOD AND APPARATUS HAVING A VARIABLE ILLUMINATED FIELD

[75] Inventors: Gérard Corbasson; Jacques Debize, both of Saint-Heand, France

[73] Assignee: Etablissements Pierre Angenieux, Saint-Heand, France

[21] Appl. No.: 210,280

[22] Filed: Mar. 18, 1994

Related U.S. Application Data

[63] Continuation of Ser. No. 972,321, Nov. 5, 1992, abandoned.

[30] Foreign Application Priority Data

Nov. 6, 1991 [FR] France ..... 91 13666

[51] Int. Cl.[6] ..... F21M 1/00

[52] U.S. Cl. ..... 362/268; 362/277; 362/319; 359/794

[58] Field of Search ..... 359/641, 794, 359/691; 362/268, 281, 277, 319

[56] References Cited

U.S. PATENT DOCUMENTS

| | | | |
|---|---|---|---|
| 1,150,350 | 8/1915 | Dussaud | 362/268 |
| 1,338,818 | 5/1920 | Dennington | 362/268 |
| 1,451,893 | 4/1923 | Ryan | 362/268 |
| 2,108,054 | 2/1938 | Eitzen | 362/268 |
| 2,347,771 | 5/1944 | Dion et al. | 362/268 |
| 2,587,956 | 3/1952 | Bastica | 362/268 |
| 3,576,358 | 4/1971 | Hayamizu et al. | 359/691 |
| 4,101,957 | 7/1978 | Chang . | |
| 4,151,584 | 4/1979 | Labrum . | |
| 4,203,652 | 5/1980 | Hanada | 359/641 |
| 4,293,892 | 10/1981 | Plummer . | |
| 4,460,943 | 7/1984 | Callahan | 362/268 |
| 4,745,526 | 5/1988 | Sestak . | |
| 4,843,529 | 6/1989 | Izenour | 362/268 |
| 5,002,375 | 3/1991 | Komplin et al. | 359/641 |

FOREIGN PATENT DOCUMENTS

| | | | |
|---|---|---|---|
| 158475 | 8/1954 | Australia | 362/268 |
| 0299196 | 1/1989 | European Pat. Off. . | |
| 136165 | 1/1934 | Germany | 362/268 |
| 2105389 | 12/1971 | Germany | 362/268 |
| 2072825 | 10/1981 | United Kingdom . | |
| 88/04389 | 6/1988 | WIPO | 362/268 |

*Primary Examiner*—Timothy Thorpe
*Assistant Examiner*—Ted Kim
*Attorney, Agent, or Firm*—Young & Thompson

[57] ABSTRACT

A lighting apparatus has a lighting filament (3), a first lens (1) disposed at a fixed distance from the filament (3), divergent light from the filament falling directly on the first lens (1) which reduces but does not eliminate the divergence of the light in all directions about the optical axis upon passage of light through the first lens, and a sleeve (12) carrying a second lens (2) mounted for sliding movement relative to the box. The second lens (2) receives divergent light directly from the first lens (1) and reduces the divergence of the light upon passage of the light through the second lens, the focal length of the second lens being greater than 1½ times the focal length of the first lens and the distance between the lenses being less than 1½ times the focal length of the first lens. The illumination pattern is high-intensity but does not have a sharp contour so that it may be used in a surgical operating room.

4 Claims, 2 Drawing Sheets

LIGHTING METHOD AND APPARATUS HAVING A VARIABLE ILLUMINATED FIELD

This application is a continuation of application Ser. No. 07/972,321, filed Nov. 5, 1992, now abandoned.

BACKGROUND OF THE INVENTION

1. Field of the Invention

The invention relates to a lighting method and a lighting apparatus having a variable illuminated field, in particular for operating-rooms.

2. Description of the Prior Art

Surgical operations call for high-intensity lighting systems which satisfy certain functional criteria. The illuminated field must have uniform lighting but must not have a sharp contour in order to avoid lighting boundaries which produce disagreeable contrasts for the surgeon's eye.

Some operating-room lighting systems project a light source on zones having fixed dimensions of contours and constant illumination. These zones can be displaced and superimposed in order to vary the level of illumination of the field under observation.

U.S. Pat. No. 4.745.526, the disclosure of which is considered as incorporated in the present disclosure, is directed to such known lighting systems.

One object of the invention is to propose a lighting system for producing at a predetermined distance from an operating-room lighting lamp an illuminated field which is variable both in dimensions and in illumination.

SUMMARY OF THE INVENTION

The invention is directed to a lighting apparatus, particularly for operating rooms, comprising a box, said box supporting a lighting filament and a first convergent lens, said convergent lens being disposed at a fixed distance of said filament, wherein a sleeve carrying a second convergent lens slides relatively to said box along an optical axis common to said filament and two said convergent lens, and wherein the focal distance of said second lens is superior to one and half times the focal distance of the first lens.

According to one embodiment of the invention, means for displacing said sleeve cooperate with two abutments, said abutments being apart from a distance inferior to one and half times the focal distance of the first lens. Said means for displacing comprises advantageously a fixing screw cooperating with a lateral groove of the box. Said screw comprises preferably a shoulder pressing on a flat surface around said groove when said second lens is in position.

The invention is also directed to a lighting method for obtaining from a lamp filament an illuminated field which is variable in diameter and in illumination, comprising following steps:

placing a first convergent lens having a fixed focal length $F_2$, in fixed relationship with the lamp filament, displacing a second convergent lens having a focal length $F_2$, this lens being placed on the other side of the first lens with respect to the filament according to a variable distance D from the first lens on the axis of the system, under the following conditions :

the focal lengths satisfy the double inequality $1.5\ F_1 < F_2 < 4\ F_1$ and the distance D between the two lenses corresponds to the double inequality $O<D<1.5\ F_1$.

BRIEF DESCRIPTION OF THE DRAWINGS

Further distinctive features will become apparent from the following description, reference being made to the accompanying drawings, in which.

DETAILED DESCRIPTION OF THE INVENTION

Figure 1:
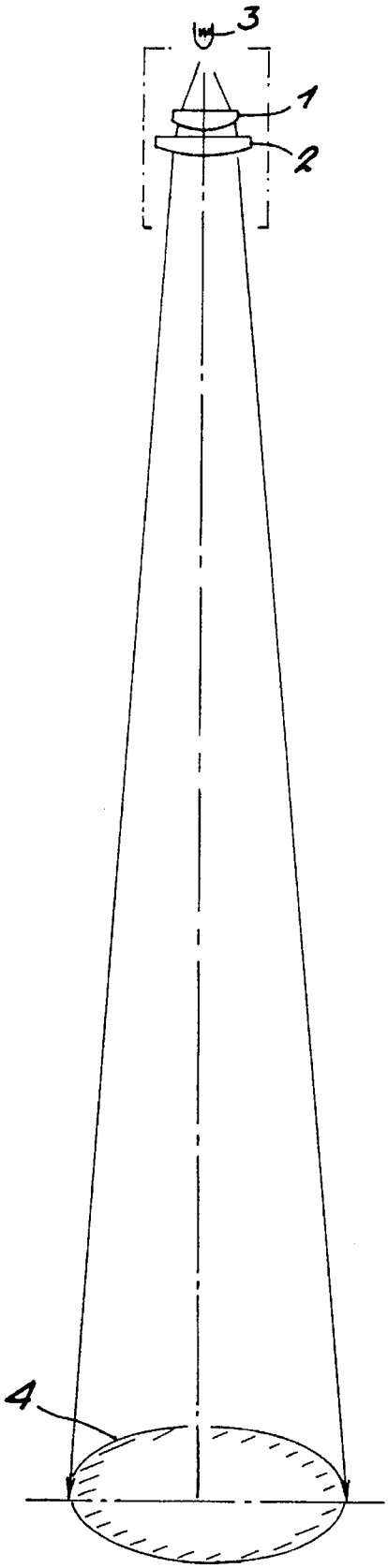
FIG. 1 is an axial sectional view of a lighting system in accordance with the invention, the two lenses of said system being located close together.

Referring to FIG. 1, it is seen that the lighting system in accordance with the invention is composed of an operating-room lighting lamp, the filament of which is represented schematically at 3, of a first convergent lens 1 which is fixed and placed near the filament 3, and of a second convergent lens 2 which is movable along the axis of the system. By "convergent" is meant that the divergence of light falling on the lens is reduced by passage through the lens.

The diameter of the first lens 1 determines the aperture of the system. The second lens 2 serves to project the illuminated field in combination with the first lens 1. At a predetermined distance from the filament 3 of the operating-room lighting lamp, the illuminated field is represented by its diameter in FIGS. 1 and 2. In FIG. 1, since the two lenses 1 and 2 are very close to each other, the illuminated field has a large diameter 4.

Figure 2:
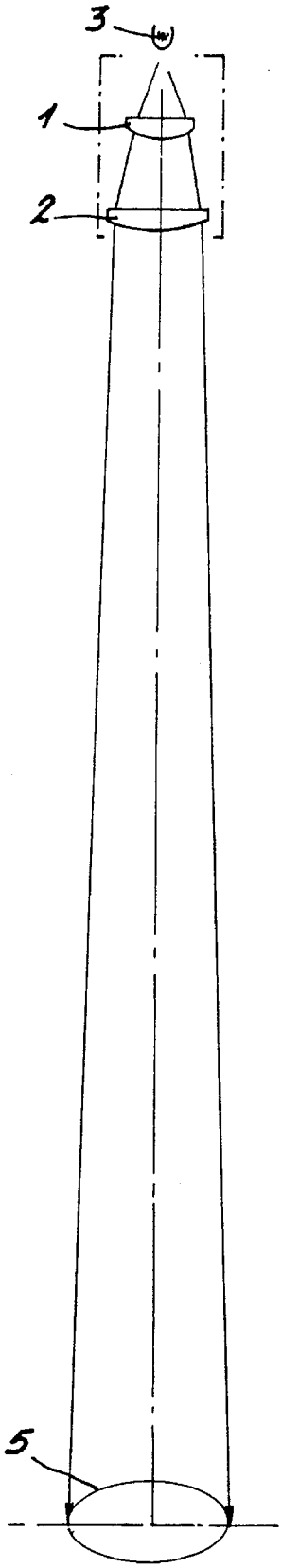
FIG. 2 is an axial sectional view of the lighting system of FIG. 1 when the two lenses are located at a distance from each other.

Referring to FIG. 2, since the two lenses 1 and 2 are spaced apart, the illuminated field has a smaller diameter 5. By varying the spacing of the two lenses, one varies the diameter of the illuminated field but the illumination of the field remains uniform.

However, when the diameter of the field varies, its illumination varies as the inverse of the square of the diameter, In order to ensure uniformity of illumination of the field, one employs the combination of the geometrical aberrations of the two lenses 1 and 2 in order to spread-out the projection spot of the filament 3 to a sufficient extent.

In a particular example of construction, the lenses 1 and 2 have the respective focal lengths :

$F_1$=67 mm and $F_2$=174 min.

The diameter of the illuminated field at a distance of 1 m varies from 220 mm (4, FIG. 1) to 130 mm (5, FIG. 2) in respect of a displacement of the second lens of 48 mm.

According to the invention, in order to obtain this uniform and variable illumination as well as the variation of illumination as a function of the variation of the illuminated field, with only two convergent lenses, the focal lengths $F_1$ and $F_2$ of the two lenses 1 and 2 respectively satisfy the double inequality :

$1.5\ F_1 < F_2 < 4\ F_1$.

And the distance D between the two lenses corresponds to the double inequality :

$O<D<1.5\ F_1$.

Figure 3:
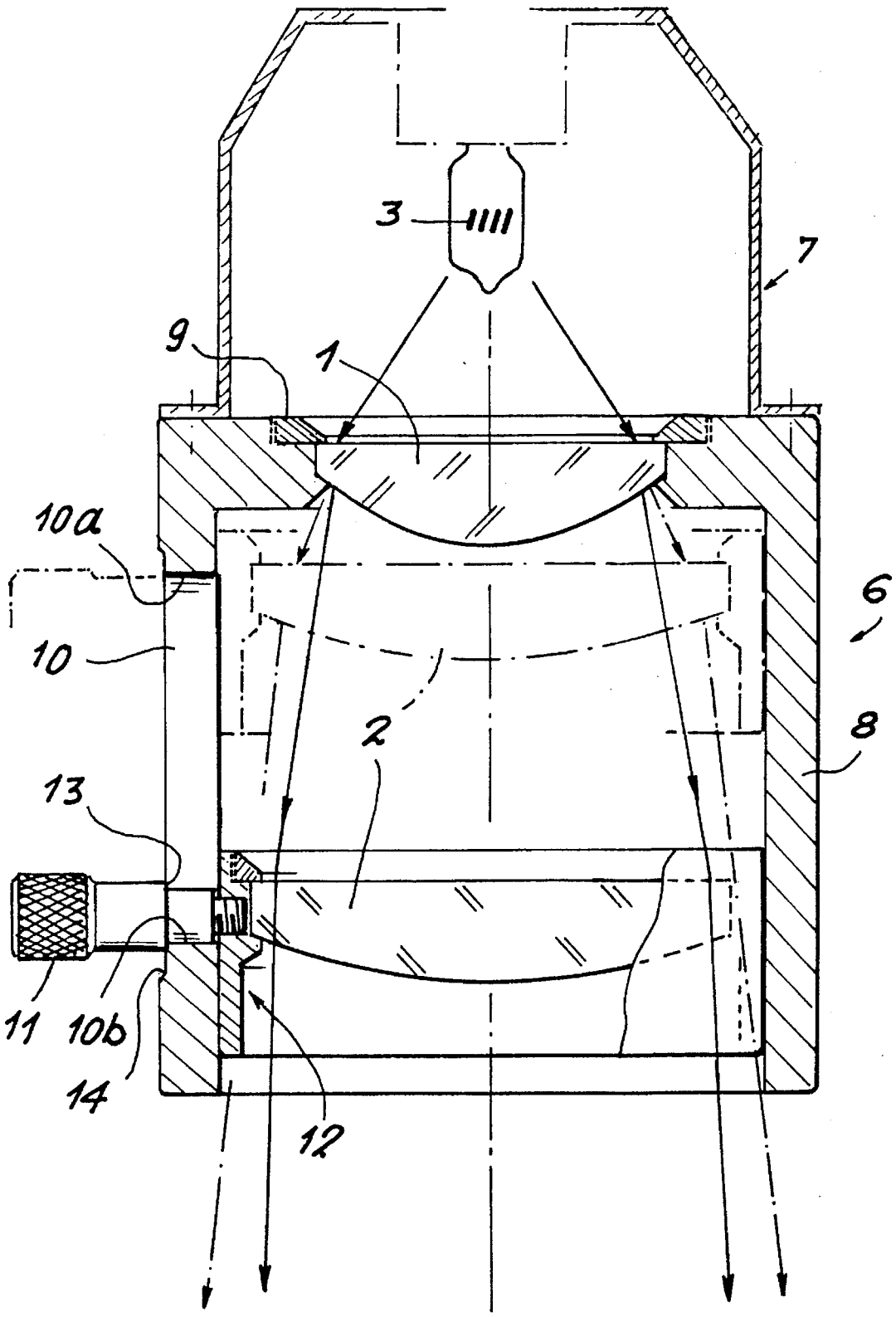
FIG. 3 is an axial sectional view of a lighting apparatus according to the invention.

Referring now to FIG. 3, an apparatus according to the invention supports in axial relationship along a common optical axis a first convergent lens 1, a second convergent lens 2 and a lighting filament 3.

To this effect, the apparatus comprises a box referred to in its whole by reference 6. The box 6 is constituted by a hood 7 and a cylinder 8 in fixed relationship.

The hood 7 receives in its inner space a filament 3. Cylinder 8 supports at one extremity a first lens 1 which is in position by a threaded ring 9.

Cylinder 8 comprises also a lateral groove 10, in which a screw 11 with a knurled head is slidably mounted.

Groove 10 is limited by two extremities 1O*a*–10*b* constituting sliding abutments for screw 11.

The screw 11 with a knurled head cooperates with a sleeve 12 supporting a second lens 12 and is advantageously provided with a shoulder 13, which presses against a flat surface 14 around the groove 10, in order to hold sleeve 12 and lens 2 in a desired position.

While the invention has been described with reference to a particular embodiment, the invention is in no way limited to this embodiment but covers on the contrary various modifications of the details and embodiments within the scope and spirit of the invention.

What is claimed is:

1. A lighting apparatus comprising a box, said box supporting a lighting filament and a first lens disposed at a fixed distance from said filament, said first lens being a figure of rotation about an optical axis, divergent light from said filament falling directly on said first lens and said first lens reducing but not eliminating the divergence of said light in all directions about said optical axis upon passage of light through said first lens, a sleeve carrying a second lens mounted for sliding movement relative to said box slidably along an optical axis common to said filament and both said lenses, said second lens receiving divergent light directly from said first lens and reducing the divergence of said light upon passage of said light through said second lens, the focal length of said second lens being greater than 1½ times the focal length of said first lens and the distance between said lenses being less than 1½ times the focal length of said first lens.

2. Lighting apparatus as claimed in claim 1, wherein the sliding movement of said sleeve is limited by two abutments, said abutments being spaced apart a distance less than 1½ times the focal distance of the first lens.

3. Lighting apparatus as claimed in claim 2, wherein means are provided for releasibly fixing the position of said sleeve, comprising a fixing screw coacting with a lateral groove of said box.

4. A lighting apparatus as claimed in claim 3, wherein said screw comprises a shoulder pressing on a flat surface about said groove when said second lens is in a selected position.

* * * * *